US011840833B2

(12) United States Patent
Witt et al.

(10) Patent No.: US 11,840,833 B2
(45) Date of Patent: Dec. 12, 2023

(54) CONNECTOR SYSTEM FOR CONTAINER-BASED STRUCTURES

(71) Applicant: WiSys Technology Foundation, Inc., Madison, WI (US)

(72) Inventors: Jacob Witt, Pardeeville, WI (US); Anthony Lichwa, Jr., Ladysmith, WI (US); Lindsey DeYoung, Richland Center, WI (US)

(73) Assignee: WiSys Technology Foundation, Inc., Madison, WI (US)

( * ) Notice: Subject to any disclaimer, the term of this patent is extended or adjusted under 35 U.S.C. 154(b) by 101 days.

(21) Appl. No.: 17/342,790

(22) Filed: Jun. 9, 2021

(65) Prior Publication Data

US 2021/0381219 A1 Dec. 9, 2021

Related U.S. Application Data

(60) Provisional application No. 63/036,576, filed on Jun. 9, 2020.

(51) Int. Cl.

| | |
|---|---|
| ***E04B 1/19*** | (2006.01) |
| ***E04C 3/04*** | (2006.01) |
| ***E04B 1/348*** | (2006.01) |
| ***E04H 1/12*** | (2006.01) |

(52) U.S. Cl.

CPC ..... *E04B 1/1903* (2013.01); *E04B 1/3483* (2013.01); *E04C 3/04* (2013.01); *E04H 1/12* (2013.01); *E04B 2001/1963* (2013.01); *E04C 2003/0486* (2013.01); *E04H 2001/1283* (2013.01)

(58) Field of Classification Search

CPC ..... E04B 1/1903; E04B 1/3483; E04B 2001/1963; E04B 2001/34884; E04C 3/04; E04C 2003/0486; E04C 3/08; E04C 3/11; E04C 2003/0491; E04H 1/12; E04H 2001/1283

See application file for complete search history.

(56) References Cited

U.S. PATENT DOCUMENTS

| | | | | |
|---|---|---|---|---|
| 5,884,824 | A | 3/1999 | Spring, Jr. | |
| 5,966,956 | A | 10/1999 | Morris | |
| 6,131,781 | A | 10/2000 | Murray | |
| 7,310,914 | B1 | 12/2007 | Moore | |
| 8,091,291 | B2 | 1/2012 | Ode | |
| 8,418,425 | B1 * | 4/2013 | Santini | E04H 3/28 52/690 |
| 8,800,238 | B2 | 8/2014 | Davies | |
| 9,109,376 | B2 * | 8/2015 | Prodaniuk | E04H 1/12 |
| 9,803,365 | B2 * | 10/2017 | Peltier | E04C 3/36 |
| 10,352,034 | B2 | 7/2019 | Boyle et al. | |
| 10,689,840 | B2 * | 6/2020 | Bonlin | E04H 1/005 |

(Continued)

*Primary Examiner* — Rodney Mintz

(74) *Attorney, Agent, or Firm* — Boyle Fredrickson S.C.

(57) ABSTRACT

A building technique uses standard shipping containers as buttresses to support a truss system that may extend between the shipping containers to provide a roof. A sliding connector system attaches the trusses to the shipping containers to accommodate variations in separation of the shipping containers presenting a versatile framing system that is insensitive to site-related variations. The sliding connector system provides incremental predetermined fastening of the trusses to the shipping containers.

21 Claims, 11 Drawing Sheets

(56) References Cited

U.S. PATENT DOCUMENTS

| | | | | |
|---|---|---|---|---|
| 2006/0207193 | A1 | 9/2006 | Lilke | |
| 2008/0110105 | A1 | 5/2008 | Boschma | |
| 2011/0036018 | A1 | 2/2011 | Hsu | |
| 2014/0008359 | A1 | 1/2014 | Ferren | |
| 2014/0325931 | A1 | 11/2014 | Prodaniuk | |
| 2015/0240474 | A1 | 8/2015 | Kokoschka | |
| 2016/0130795 | A1 | 5/2016 | Downey | |
| 2017/0073971 | A1* | 3/2017 | Peltier | E04C 3/36 |
| 2018/0209135 | A1* | 7/2018 | Boyle | E04H 1/005 |
| 2019/0153720 | A1* | 5/2019 | Bonlin | E04H 1/02 |
| 2022/0074194 | A1* | 3/2022 | Clark | E04H 1/12 |

* cited by examiner

CONNECTOR SYSTEM FOR CONTAINER-BASED STRUCTURES

CROSS REFERENCE TO RELATED APPLICATION

This application claims the benefit of U.S. provisional application 63/036,576 filed Jun. 9, 2020 and hereby incorporated by reference.

STATEMENT REGARDING FEDERALLY SPONSORED RESEARCH OR DEVELOPMENT

N/A

BACKGROUND OF THE INVENTION

The present invention relates generally to a method and apparatus for rapidly constructing temporary storage facilities, and specifically, to a system of building construction using standard shipping containers.

Shipping containers are widely used for the transportation of goods internationally and have standardized dimensions allowing them to be readily conveyed using a variety of different transportation modalities including ships, trains, and trucks. These containers are often called "intermodal" containers because of their versatility.

Intermodal shipping containers are normally constructed using a sturdy steel frame with corrugated steel side walls. Special fittings ("castings") are placed in the corners of the containers at precise locations to allow the containers to be stacked and locked with other similar containers in a "twist lock" fashion so they can be stacked, for example, on the decks of transport ships.

After a period of use, shipping containers are retired from shipping but still retain substantial strength. The availability of such containers, has led to their use in the construction of buildings, for example, by connecting multiple shipping containers together and cutting openings therebetween to construct a larger structure.

SUMMARY OF THE INVENTION

The present invention employs shipping containers for the construction of temporary shelters, but instead of using the shipping container volume as the structure volume, the invention uses the shipping container as an outer buttress wall to the structure. The standard dimensions of the shipping container allow truss structures to be attached to the shipping containers using standardized, reusable prefabricated components. The truss structure provides a roof to an interior volume arbitrarily larger than the shipping container volumes as defined by the separation of two containers. Attachment between the trusses and the containers may be by means of a rail system accommodating a range of building sizes with the same prefabricated structures as well as minor site-related variations.

The present invention employs a truss structure that may be attached to the rail system by connectors with releasable fasteners permitting attachment of the truss structure to the shipping containers at varied distances along the rail at predetermined positions. The connectors allow for incremental adjustments in transverse building width and distance between shipping containers.

Specifically, the present invention provides a building using a first and second shipping container separated along a first axis in spaced opposition flanking a building volume.

Each of the shipping containers supports a set of rails extending parallel to the axis and releasably attached to upper surfaces of the shipping container. Connectors attach endpoints of a set of trusses to opposed corresponding rails on the first and second shipping containers, the connectors attachable to the rails. The connectors are adapted to releasably fasten to the rails at a range of predetermined positions along the rails.

It is thus a feature of at least one embodiment of the invention to provide a building system using standard parts that can nevertheless construct different sizes of buildings by sliding the connectors along the rails on the top of the shipping containers and that can accommodate variations in the placement of the shipping containers which are ideally placed before assembly begins.

The connectors may provide clamp surfaces receiving walls of the rails therebetween to slidably guide the connector along the rails and then to fasten to the rails by bolt through holes in the rails.

It is thus a feature of at least one embodiment of the invention to use an incremental bolting mechanism that allows fine adjustment of the location of the ends of the trusses with respect to the shipping containers.

The lower ends of the clamp surfaces may include a pair of holes to be aligned with a pair of holes in the rails for receiving bolts therethough.

It is thus a feature of at least one embodiment of the invention to provide a simple mechanically advantaged attachment system using readily available bolts.

The connectors may provide connection plates attached to the endpoints of each truss.

It is thus a feature of at least one embodiment of the invention to provide a simple but high strength attachment of the truss to the rail connector, for example, by welding before or after assembly of the building.

The clamp surfaces may be plates extending vertically downward from the connection plates and flanking both sides of the rails.

It is thus a feature of at least one embodiment of the invention to provide rapid attachment of the trusses to the shipping containers.

The trusses may be gable trusses angling upward from each shipping container to an apex point positioned between the shipping containers and each truss includes upper and lower chords joined by a vertical strut or vertical web member and a support rail attached on opposite sides of the apex point.

It is thus a feature of at least one embodiment of the invention to provide a lightweight truss structure with a wide span that can support anticipated snow and wind loads.

The connection plates may be attached to a lower surface of the upper chord of each truss.

It is thus a feature of at least one embodiment of the invention to distribute the loads of the trusses to attachment points that run along the upper chord, vertical strut or vertical web member, and lower chord and thus preventing stress on a single attachment point.

The connection plates may be attached to a lower surface of the lower chord of each truss.

It is thus a feature of at least one embodiment of the invention to exploit the prefabricated components of the truss to simplify attachment of the truss to the rail connector.

The connection plates may provide clamp surfaces receiving a vertical wall of the lower chord and overlapping lower walls of the lower chord to prevent upward motion of the truss.

It is thus a feature of at least one embodiment of the invention to provide rapid installation of the truss to the rail and limit the need for specialized tools or time-consuming assembly techniques.

The connection plates may be angled to receive a lower angled surface of the truss.

It is thus a feature of at least one embodiment of the invention to make use of the standard components of prefabricated trusses to create connectors that are compatible and standardized for attachment to rails of shipping containers.

A set of purlins may extend perpendicular to the set of trusses where the purlins may be steel tubes.

It is thus a feature of at least one embodiment of the invention to provide high-strength attachment points for the trusses that can distribute the loads of the trusses to solid points of attachment on the sturdy purlins.

Vertical beams may attach to facing walls of the first and second shipping containers at ends of the first and second shipping containers.

It is thus a feature of at least one embodiment of the invention to provide high-strength end beams that can support common building elements such as garage doors and personnel doors.

Beam connectors may attach the vertical beams to the set of purlins, the connectors being L-shaped brackets attachable to the vertical beams and purlins at approximate 90 degree angles.

It is thus a feature of at least one embodiment of the invention to provide attachment points for end walls that can be used to provide predictable termination at prefabricated end wall components.

The vertical beams may be anchored below the ground by helix anchors.

It is thus a feature of at least one embodiment of the invention to resist high longitudinal wind forces.

The purlins may support rails with channels for receiving and retaining polymer sheet material to cover an upper surface of the trusses as a roof covering.

It is thus a feature of at least one embodiment of the invention to construct common building components such as covered roofs with lightweight material to assemble useful building constructions on site.

The sheet material may include Keders and the rails may provide Keder channels for retaining the Keders.

It is thus a feature of at least one embodiment of the invention to provide a rapid method of sheathing the structure using architectural fabrics.

The sheet material may comprise multiple panels of material and the panels of material may include zippers and flaps of Velcro extending over the zippers for sealably joining multiple panels of material.

It is thus a feature of at least one embodiment of the invention to facilitate rapid installation of fabric over the trusses and provide waterproof or water resistant roof coverings sealing connection points between panels of material and between the trusses and sidewalls and endwalls.

A supplemental panel of material may be attached at one end to an endpoint of each truss and may be attached at a second end to the rail to span an opening between the truss and the rail.

It is thus a feature of at least one embodiment of the invention to accommodate different truss styles and to close gaps between truss overhangs (over the shipping containers) and the rail.

A supplemental panel of material may span an apex point of the trusses and may be attached to attachment points on opposite sides of the apex point.

It is thus a feature of at least one embodiment of the invention to close gaps between sheets of material joined at the apex point of the trusses.

The first and second container may be separated by at least 20 feet or at least 40 feet or at least 60 feet.

It is thus a feature of at least one embodiment of the invention to provide large sized buildings between shipping containers that are able to withstands high winds and snow loads.

In an alternative embodiment of the present invention, a method of constructing a building employs a first and second shipping container separated along a first axis in spaced opposition flanking a building volume; a set of rails extending parallel to the axis and releasably attached to upper surfaces of the first and second shipping containers; a set of trusses extending between endpoints; and connectors attaching the endpoints of each truss to opposed, corresponding rails on the first and second shipping containers, the connectors attachable to the rails wherein the connectors are adapted to releasably fasten by bolt to the rails at a range of predetermined positions along the rails. The method comprises the steps of (a) placing the first and second shipping containers in separation along a first axis in spaced opposition flanking a building volume (b) attaching the set of rails to the upper surfaces of the first and second shipping containers to extend parallel to the axis and be separated from each other perpendicular to the axis; and (c) attaching the trusses to the rails using the connectors.

These particular objects and advantages may apply to only some embodiments falling within the claims and thus do not define the scope of the invention.

DETAILED DESCRIPTION OF THE PREFERRED EMBODIMENT

Embodiment 1

Figure 1:
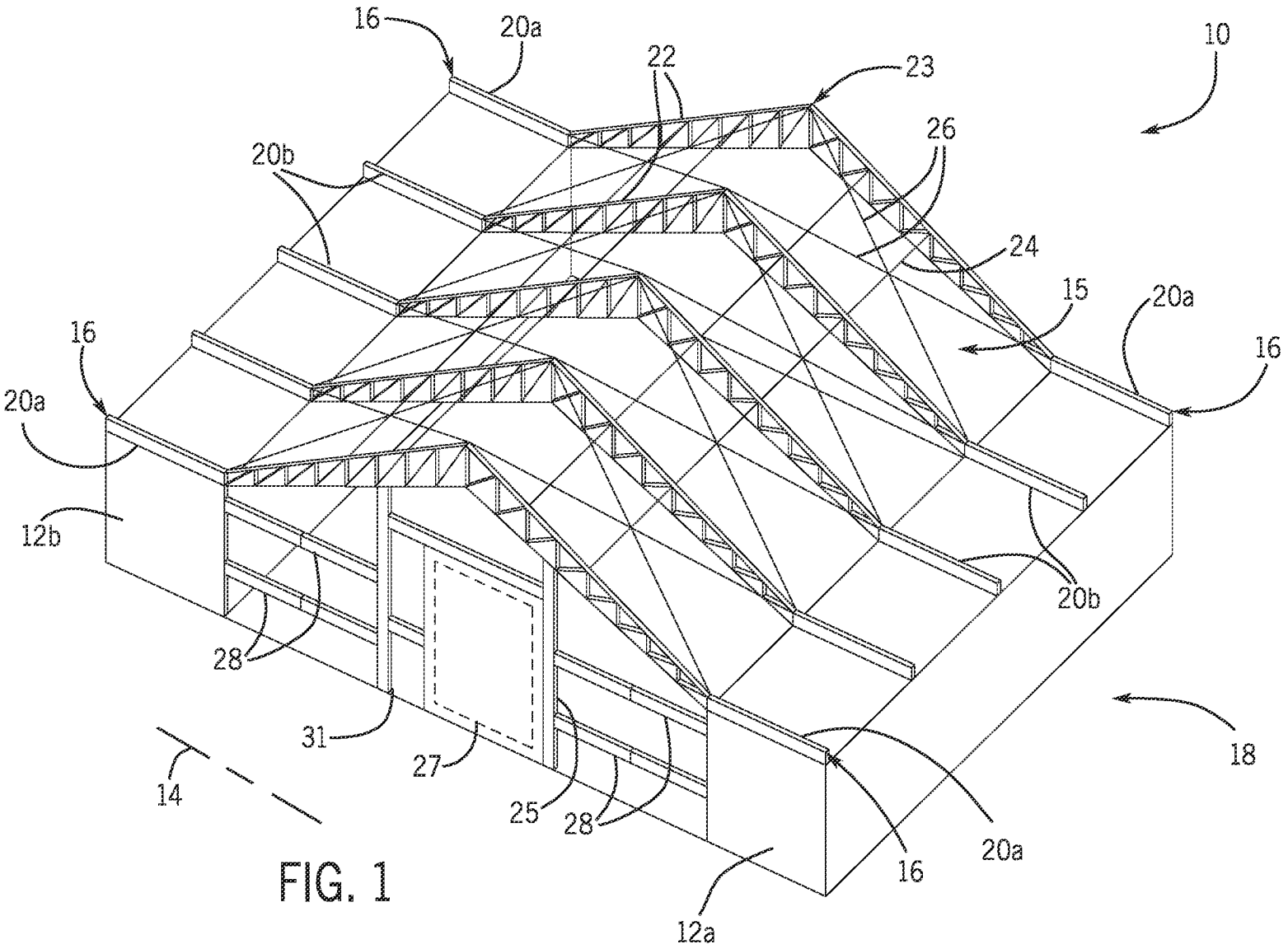
FIG. 1 is a perspective view of a structure constructed according to the present invention showing shipping containers positioned to flank a structure volume spanned by gabled trusses in sliding connection with the shipping container.

Referring now to FIG. 1, a structure 10, suitable for temporary storage may provide for a first and second shipping container 12*a* and 12*b* separated along a transverse axis 14, for example, by 20-60 feet or at least 20 feet or at least 40 feet or at least 60 feet, to flank a building volume 15. The shipping containers 12 may be placed directly on the ground 18 which may be groomed to be substantially level.

Generally, the shipping containers 12 may conform with ISO standard 668, Series 1 freight containers—classification, dimensions, and ratings 2013; 6:1-16. The height and length of such containers 12 may vary; however, the width of the containers 12 is fixed at eight feet and the height is usually 8½ feet. The longitudinal length of the containers 12, perpendicular to the transverse axis 14, may vary from 20 to 60 feet and multiple containers may be attached together (for example, using lashing bridge fittings) to extend this distance.

Each container 12 has a box-like frame of steel and corrugated sheet steel sides welded to the frame. The eight corners of the frame expose a special corner casting 16 of standard dimensions and locations as will be discussed below.

Referring still to FIG. 1, the upper horizontal walls of the containers 12 support transverse parallel spaced apart rails 20, for example, each rail 20 separated by 10 feet to provide five rails over the length of the shipping containers 12. The rails 20 have two styles, a first style of rail 20*a* being placed at the ends of the shipping container and a second style of rail 20*b* placed therebetween.

Gabled planar trusses 22 extend transversely between the rails 20 extending upward from each rail 20 to an apex 23 approximately ten feet above the tops of the containers 12 and substantially midway between the containers 12. Desirably, each truss 22 is constructed of aluminum and is limited in weight to less than 200 pounds and desirably less than 110 pounds for easy manual installation on-site.

Rigid longitudinal braces 24 may extend longitudinally between each truss 22, and diagonally extending cross bracing 26 may connect between connection points, a first connection point being near the connection between the truss 22 and the rail 20, and the second connection point being near the apex 23 of an adjacent truss 22. The longitudinal braces 24 and cross bracing 26 resist longitudinal motion of the trusses 22 and parallelogram distortion.

Vertically extending sidewalls of the structure 10 are formed by abutting vertically extending walls of the containers 12. Vertical end walls of the structure 10 may be formed by standard dimension prefabricated metal beams 25 (e.g., steel) framing a standard garage door 27 or the like and an adjacent personnel door 31. These prefabricated metal beams 25 may be joined to the containers 12 using telescoping beams 28 that accommodate different transfer widths of the structure 10 as will be discussed below.

The outer surfaces of the structure 10 may be clad with an architectural fabric of the type used for the construction of tents attached to the prefabricated components as will also be discussed below. Generally, each of these components is reusable and may be shipped between sites rapidly, for example, with those components other than the containers 12 stored in one of the containers 12.

Figure 2:
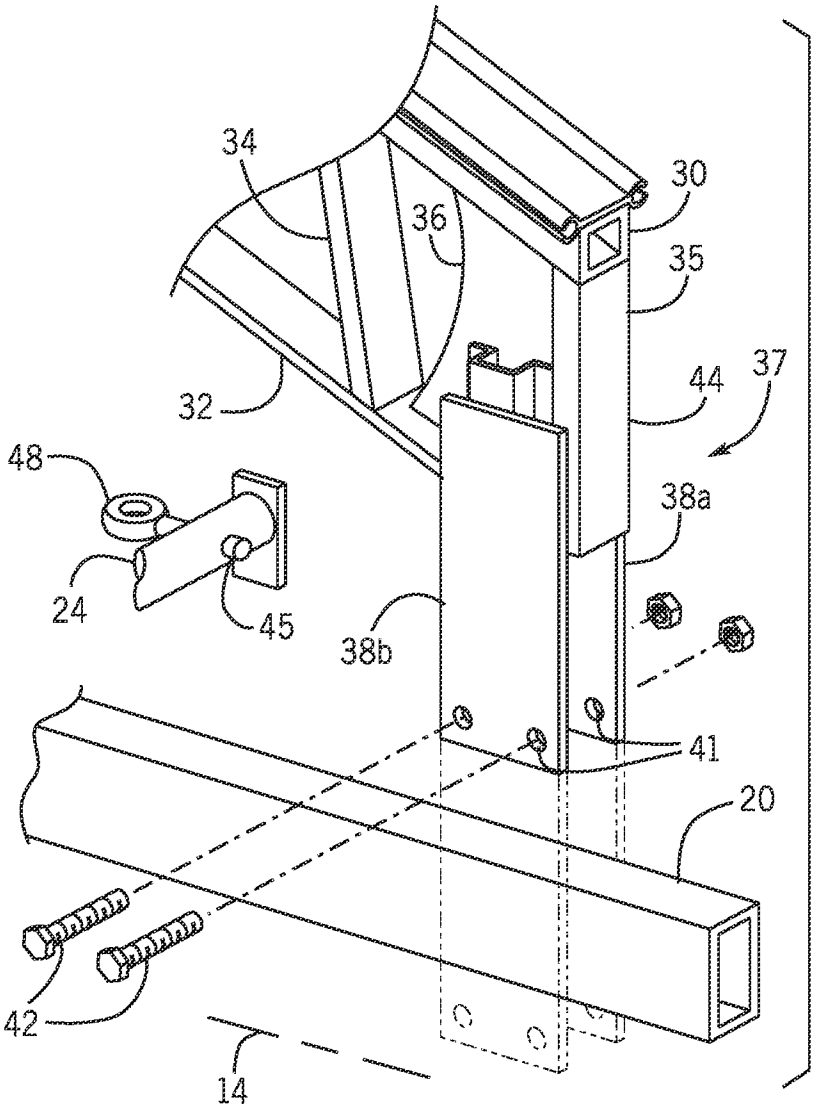
FIG. 2 is a fragmentary exploded perspective view of the sliding connection between the trusses and the shipping containers through connectors attached to rails.

Referring now to FIGS. 1 and 2, each of the trusses 22 will provide for upper and lower transversely extending chords 30 and 32, respectively, with the upper chord 30 constructed of 6061 aluminum square tubing and the lower chord 32 constructed of aluminum tubing with a circular cross-section. Zigzagging web members or diagonal struts 34 extend between the upper and lower chords 30 and 32, which diverge slightly toward the apex 23, attach to the upper and lower chords 30 and 32 by welds. In one embodiment the trusses 22 may be divided into two components at a bolted vertical seam along an apex 23 for simplicity in shipping and handling.

Opposed ends of the upper and lower chords 30 and 32 are joined at each end by a vertical strut 35 (for example, welded between the upper chords 30 and lower chords 32) and a vertically extending web plate 36 welded to the upper chords 30, the lower chords 32 and the vertical strut 35 for added stiffness.

A coupling 37 is attached to each end of each truss 22 formed of pairs of opposed parallel clamp plates 38*a* and 38*b* extend downwardly from flanking sides of the front and back of the vertical strut 35 (as welded thereto) to provide a downwardly extending sleeve that may receive rail 20 attached to the upper surface of the cargo container 12. The clamp plates 38 may generally flank sidewalls of the rail 20 with the top of the rail 20 abutting the bottom of the vertical strut 35 and web plate 36 to provide a sliding connection between an end of the truss 22 and the rail 20 along the transverse axis 14.

Figure 3:
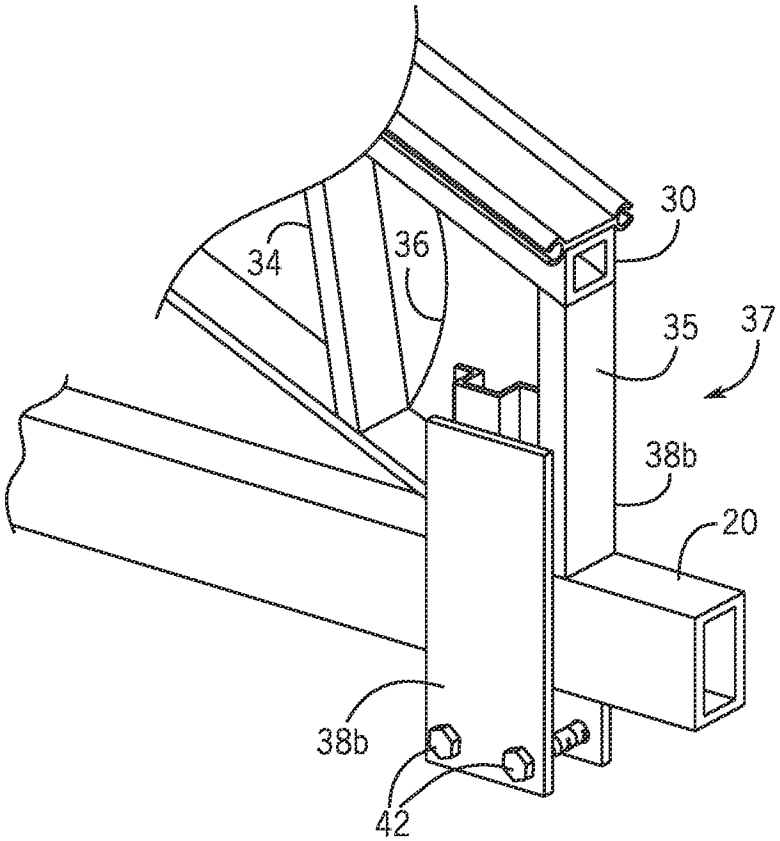
FIG. 3 is a figure similar to FIG. 2 with the connector attached to the rail and secured thereto.

Referring also to FIG. 3, longitudinally aligned holes 41 may be placed in the lower edges of the clamp plates 38, the latter of which extend below the rail 20. The holes 41 may receive carriage bolts 42 or the like which when tightened draw the clamp plates 38 tightly against the sidewalls of the rail 20 at an arbitrary transverse position on the rail 20 to prevent further transverse movement by promoting a high degree of frictional contact between the clamp plates 38 and the rail 20.

Referring again to FIG. 2, the web plate 36 may support an upwardly open rectangular pocket weldment 44 to receive a corresponding downwardly extending tab 45 attached at both ends of cross braces 24 allowing each cross braces 24 to be quickly attached to a truss 22 to extend between trusses 22. In this respect, the cross braces 24 may be a standard length of metal tubing, for example, approximately 10 feet in length, to match the separation between the rails 20. An eye-loop 48 may be attached to the ends of the cross braces 24 to accept attachment of one end and the cross bracing 26 shown in FIG. 1. The other end of the diagonal cross bracing 26 may be attached to a corresponding eye-loop (not shown) attached at an apex 23 of the truss 22.

Figure 4:
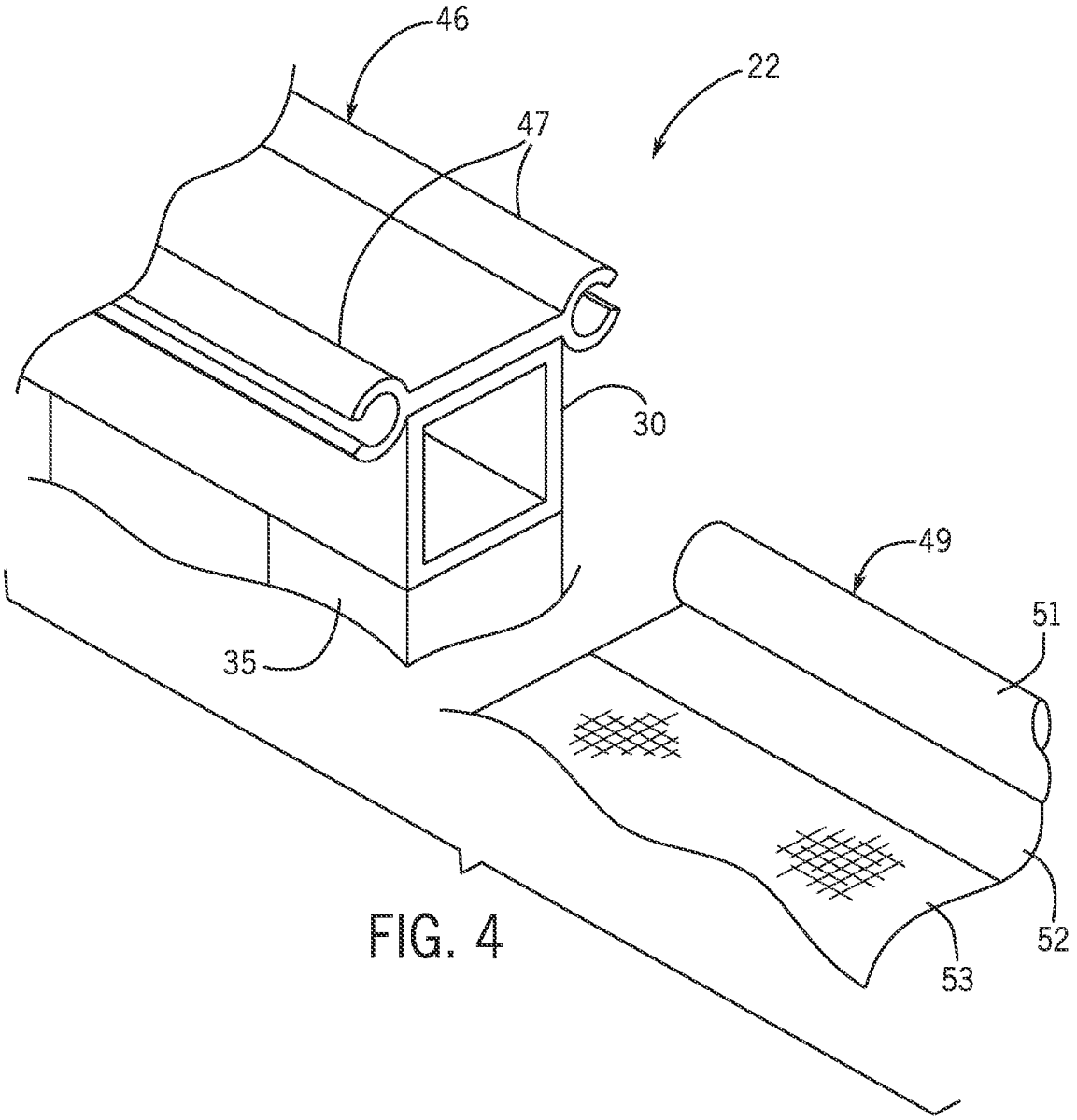
FIG. 4 is a fragmentary perspective view of a Keder rail and Keder for attachment of flexible roofing material between the trusses.

Referring now to FIGS. 2, 3 and 4, an upper surface of the upper chord 30 may support a Keder rail 46 providing open circular channels 47 facing in opposite longitudinal directions and extending along the entire upper edge of the truss 22. These channels 47 may receive a Keder strip 49, the latter providing a circular cross-section edge strip 51, for example, provided by a flexible PVC tube, and in turn joined by an attachment strip 52 which may be glued or welded to a flexible architectural fabric 53 such as vinyl. In this way the architectural fabric 53 may be rapidly attached to the structural components of the structure 10. The fabric 53 may be sized to extend over the full 20 to 60-foot span of the trusses 22 and may make use of known materials for 10 construction such as a vinyl or fabric tent material.

Figure 5:
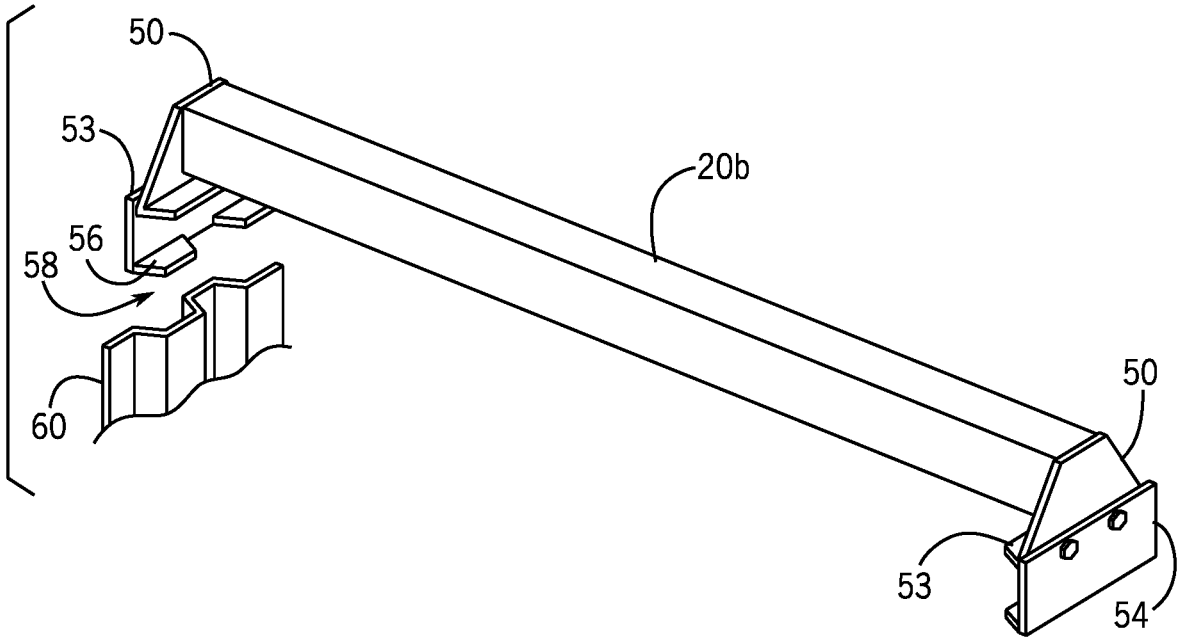
FIG. 5 is a perspective view of a first form of the rails of FIG. 2 and fragmentary portion of an outer wall of a shipping container having corrugations engaged by ends of the rails.
Figure 6:
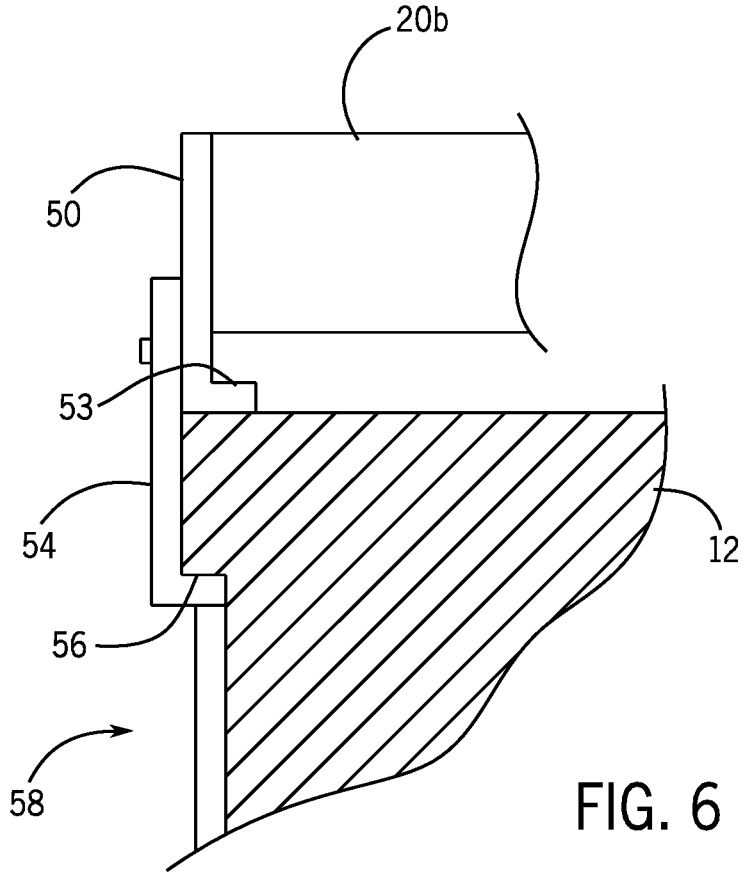
FIG. 6 is an elevational cross-section through the shipping container and rail of FIG. 5 showing attachment of an end of the rail to the shipping container.

Referring now to FIGS. 1, 5 and 6, the rails 20*b* on the upper surface of the containers 12, as noted above, may be in the form of a transversely extending rectangular steel tube that may receive the sliding coupling 37, shown in and described with respect to FIGS. 2 and 3, attaching the trusses 22 to the containers 12. Generally, the length of the rail 20*b* (and 20*a*) will be equal to the full transverse width of the containers 12 allowing adjustments of the sliding coupling 37 along the rails 20 to accommodate a separation of the shipping containers 12 (and hence a width of the internal volume 15) from 20-60 ft. without changing the length of the roof truss 22.

Each of the rails 20*b* may be attached at its ends to a vertically extending weldment 50 extending downward therefrom to terminate at an inwardly extending ledge 55 that may rest on top of the cargo container 12 to space the bottom of the rail 20*b* from the surface of the cargo container 12 allowing passage of the bolts 42 and clamp plates 38 slightly below that rail 20*b* as discussed with respect to FIGS. 2 and 3.

A locking plate 54 may be bolted to the outside of weldment 50 to extend further downward therefrom and may include transversely inwardly extending teeth 56 which engage recesses 58 in the corrugated sidewalls 60 of the containers 12 to prevent longitudinal movement of the rail 20*b* when the locking plates 54 are attached to the weldments 50. Bolts are received within the vertically extending slots in locking plate 54 to allow a degree of vertical adjustment.

Figure 7:
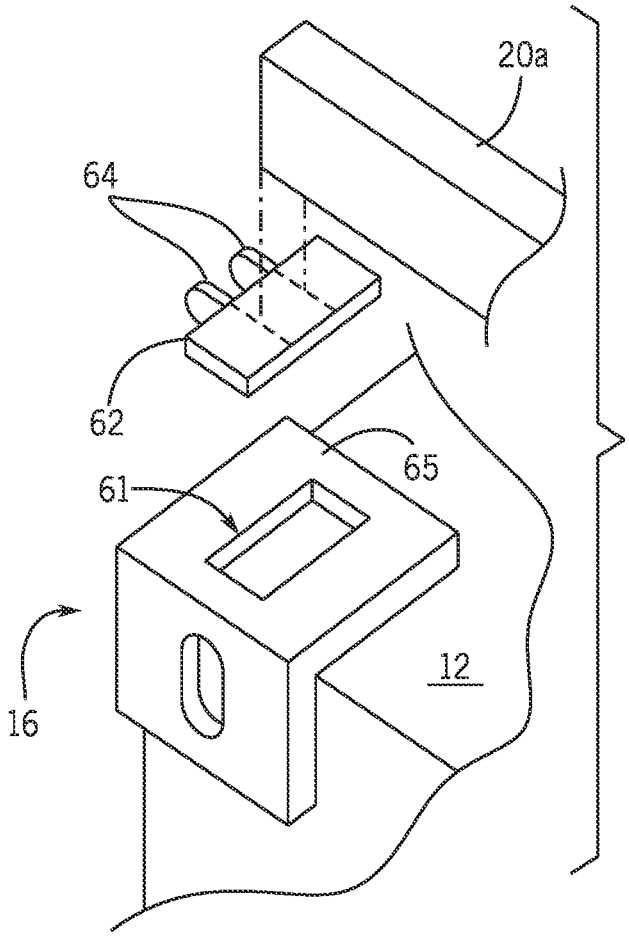
FIG. 7 is a fragmentary perspective view of a corner casting on a standard shipping container showing, in exploded form, a first end a second form of the rails of FIG. 2 attaching to the corner casting by teeth fitting within the corner casting.
Figure 8:
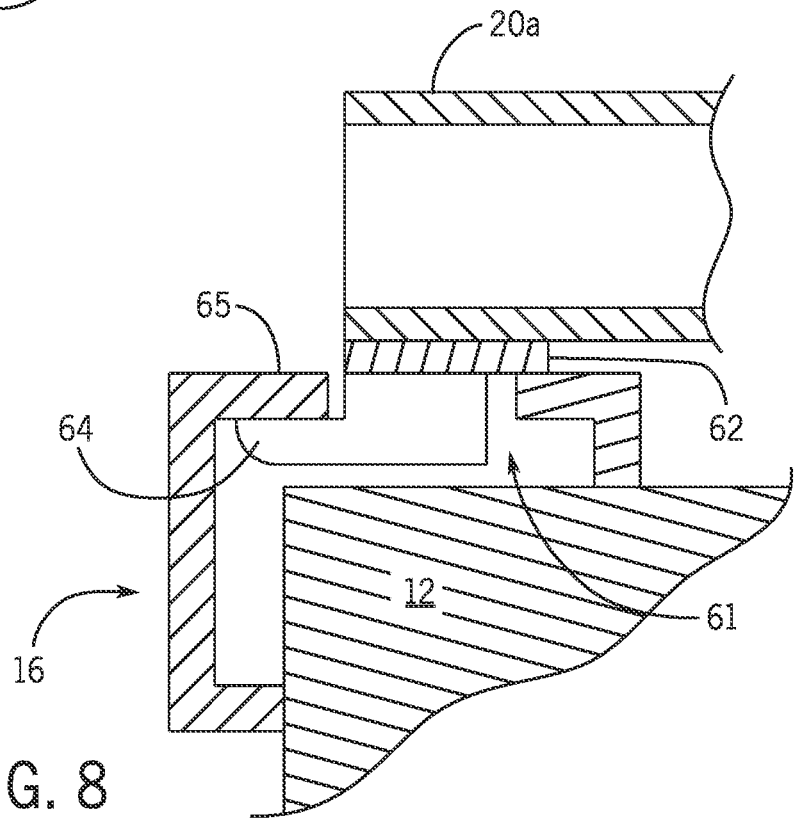
FIG. 8 is an elevational cross-sectional view through the corner casting showing engagement of the teeth beneath the surface of the corner casting.

Referring now to FIGS. 1, 7 and 8, in contrast, the first rails 20*a* may attach to the containers 12 by means of the corner castings 16 which provide an upwardly open longitudinally extended slot 61. A first end of each rail 20*a* may be attached to the corner casting 16 by means of a hook plate 62 having transversely extending hook teeth 64 which may be maneuvered beneath a lip 65 forming a transverse outer edge of the slot 61 by tipping the rail 20 downward toward the corner casting 16 to fit the hook teeth 64 beneath that lip 65 resisting upward motion of the rail 20*a* when the rail 20*a* is kept level with the top of the container 12. The hook plate 62 may be welded to a lower edge of one end of the rail 20*a*.

Figure 9:
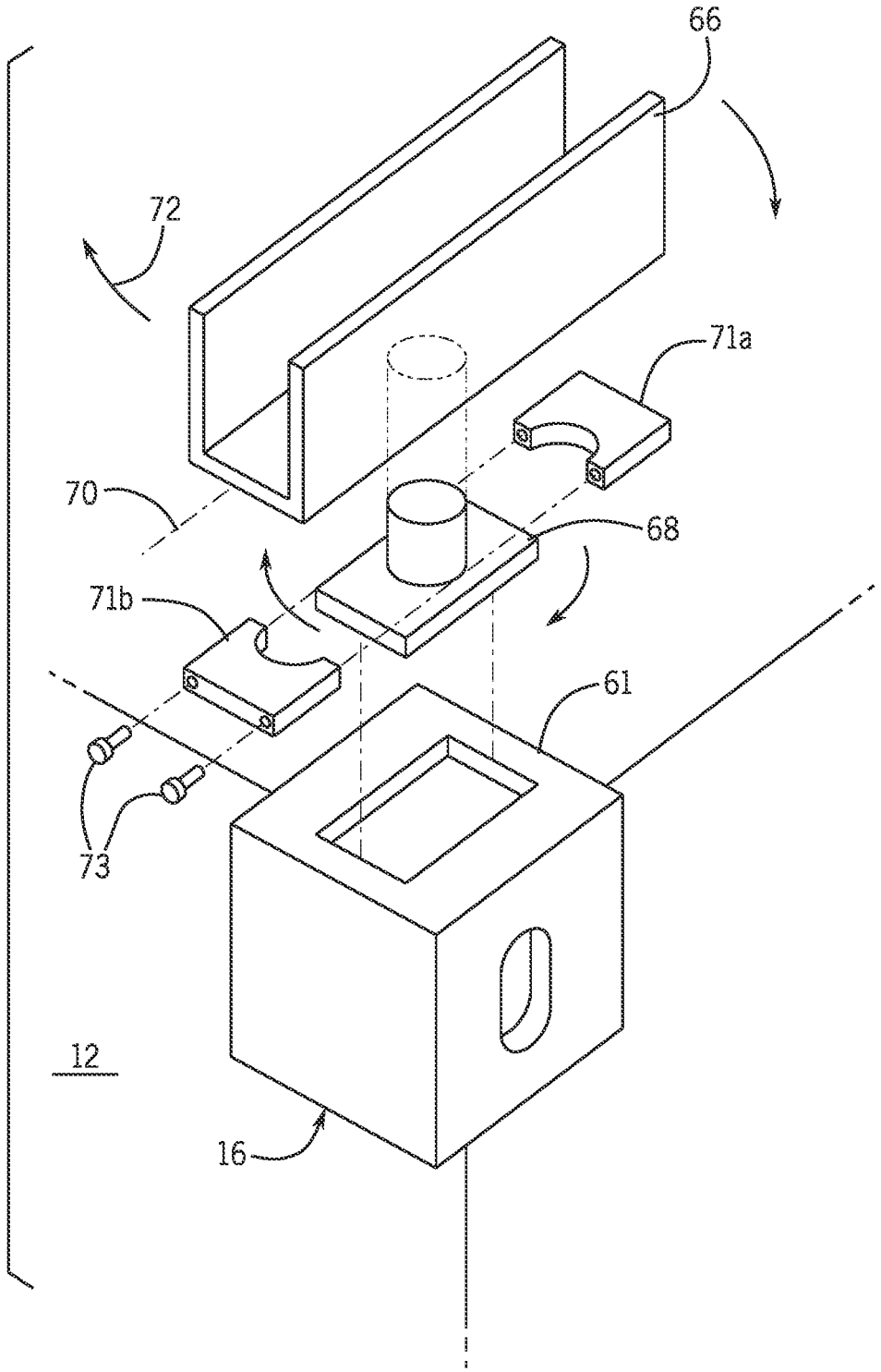
FIG. 9 is an exploded perspective view of a corner casting opposite the corner casting of FIG. 7 showing a twist lock T-fitting for engaging the second corner casting and then rotating it into a locked configuration.
Figure 10:
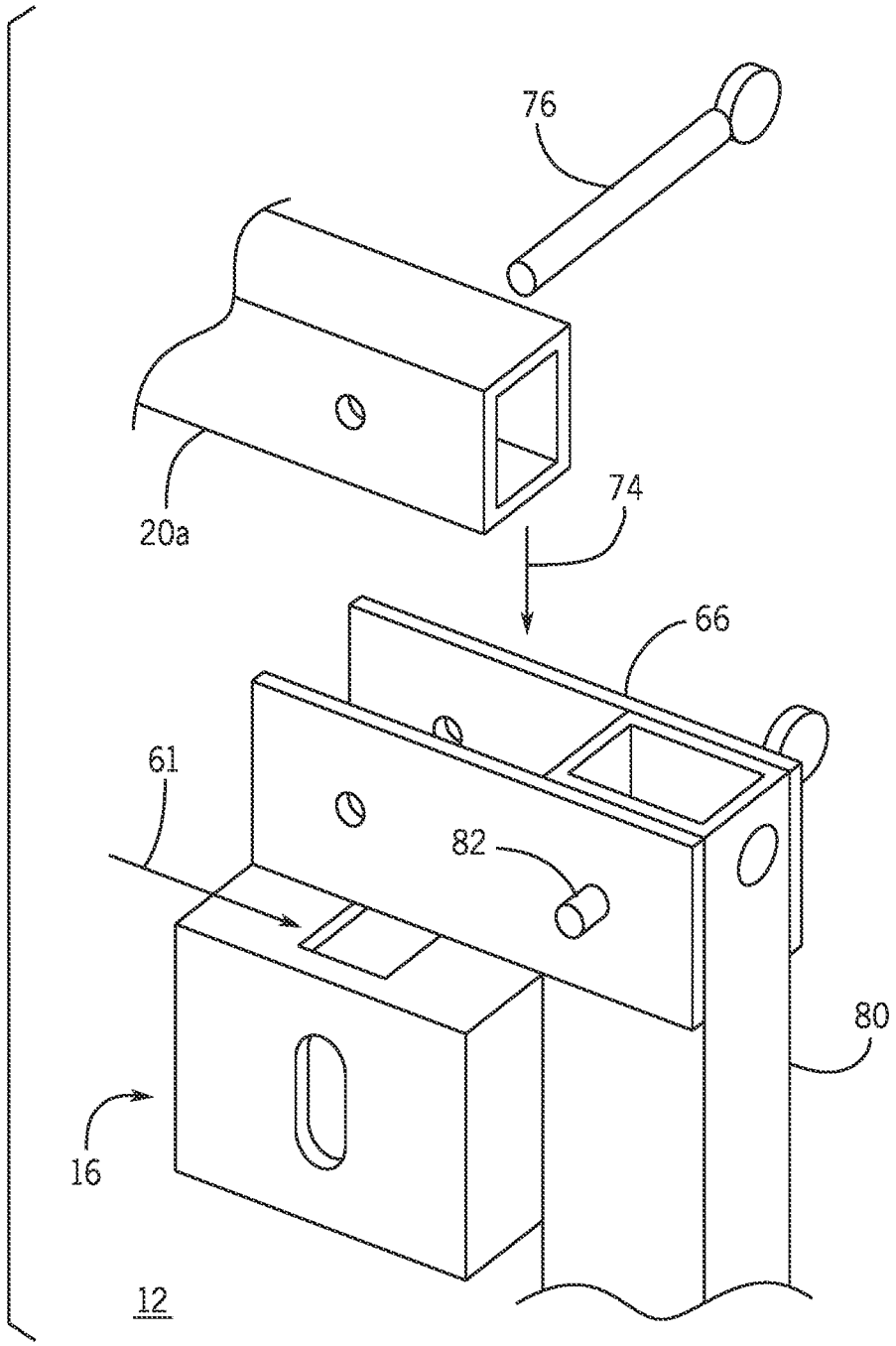
FIG. 10 is a fragmentary perspective view of the twist lock sleeve of FIG. 9 twisted into position and receiving the rail of FIGS. 7 and 8 and a vertical rail similar in construction to the rail of FIG. 7.

Referring now to FIGS. 9 and 10, the remaining end of rail 20*a* may be received within a swivel collar 66 providing an upwardly open U-channel sized to receive the rail 20*a*. The bottom of the swivel collar 66 may attach to a downwardly extending tee fitting 68 that may be received within the slot 61 of a corner casting 16 on the opposite end of the container 12 transversely opposed to the corner casting 16 of FIG. 7 when the swivel collar 66 has its channel axis 70 oriented longitudinally. A rotation of the swivel collar 66 (as indicated by arrow 72) so that channel axis 70 is transversely aligned, locks the tee fitting 68 after it is inserted through the slot 61, and hence locks the swivel collar 66 to the corner casting 16. At this time the rail 20*a* may be dropped into the collar 66 as indicated by arrow 74 and attached thereto by means of a clevis pin 76 or the like.

A swivel spacer 71 formed of halves 71*a* and 71*b* may fit around the downward shaft of the tee fitting 68 to freely rotate thereabout as attached together, for example, by machine screws 73. This swivel spacer 71 fills the length and width of the slot 61 of the corner casting 16 to resist movement of tee fitting 68 in the direction parallel to the walls of the containers 12 when the tee fitting 68 is engaged with the corner casting 16.

A portion of the swivel collar 66 extends beyond the end of the rail 20*a* in cantilever over an inner edge of a vertical wall of the container 12 to receive a vertical beam 80 extending vertically downward from a first end positioned within the swivel collar 66 and attached by pin 82. The opposite end of the vertical beam 80 may attach to a lower corner casting 16 directly below the corner casting 16 shown in FIG. 12 using the attachment mechanism shown with respect to FIGS. 7 and 8 albeit with the hook teeth 64 oriented vertically downward from the end of the vertical beam 80. The vertical beam 80 provides additional resistance against upward forces on the rail 20*a*, for example, from wind loads on the trusses 22, and also provides an attachment point for the end walls which will be now discussed.

Figure 11:
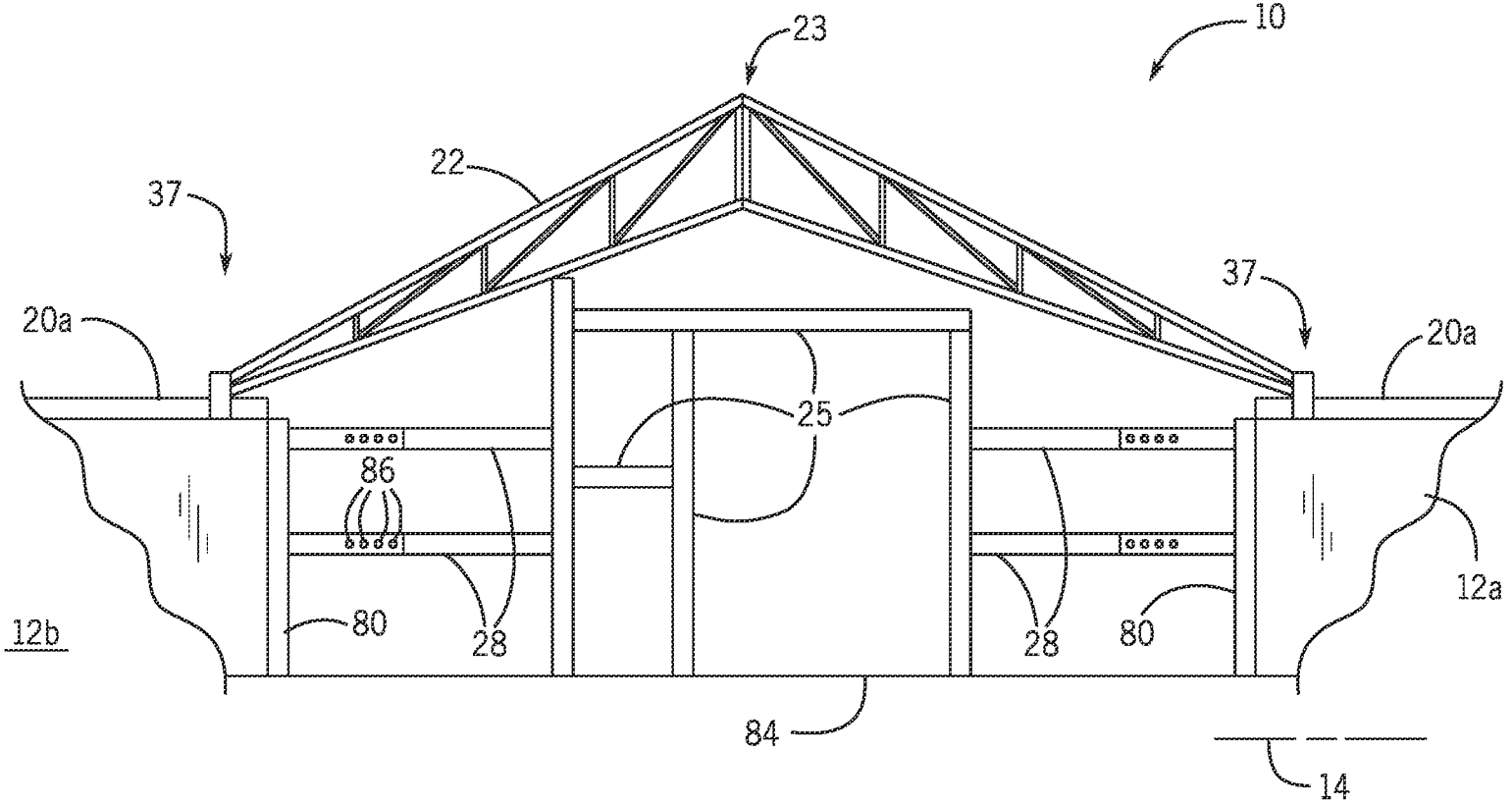
FIG. 11 is a front elevational view of the assembled structure showing the use of telescoping beams for completion of the end walls.

Referring now to FIG. 11, end walls of the structure 10 may be formed by prefabricated beams 25, as described above, extending from a sill plate 84 passing horizontally transversely along the ground between lower edges of the stabilizing beams 80 of the left and right flanking containers 12 as discussed above. These prefabricated beams 25 may be of known dimensions regardless of the separation of the containers 12 since their position approximately midway between the containers 12 is largely insensitive to precise separation of the containers 12. Accommodating variation in the separation of the containers 12 may be achieved by telescoping beams 28. These telescoping beams, for example, may be nested concentric square steel tubes whose length is adjusted and fixed by means of alignment of multiple holes 86 in one tube with a corresponding hole in the other two that may together receive a clevis pin or the like. The holes 86 successively line up with slotted holes in the outer tube (not shown) to provide a continuous range of locking adjustments.

The prefabricated beams 25 and stabilizing beams 80 may include Keder rails 46 (not shown) described with respect to FIG. 4 to allow sheathing of the end walls with architectural fabric. The ends of the beams 28 and 25 may have flanges for receiving bolts attaching the flanges pre-drilled and tapped holes in the trusses 22, beams 25 or sill plate 84. Dimensions framed by the prefabricated beams 25 for the personnel door and garage door may be filled by those structures and/or prefabricated panels of known dimension.

Embodiment 2

Figure 12:
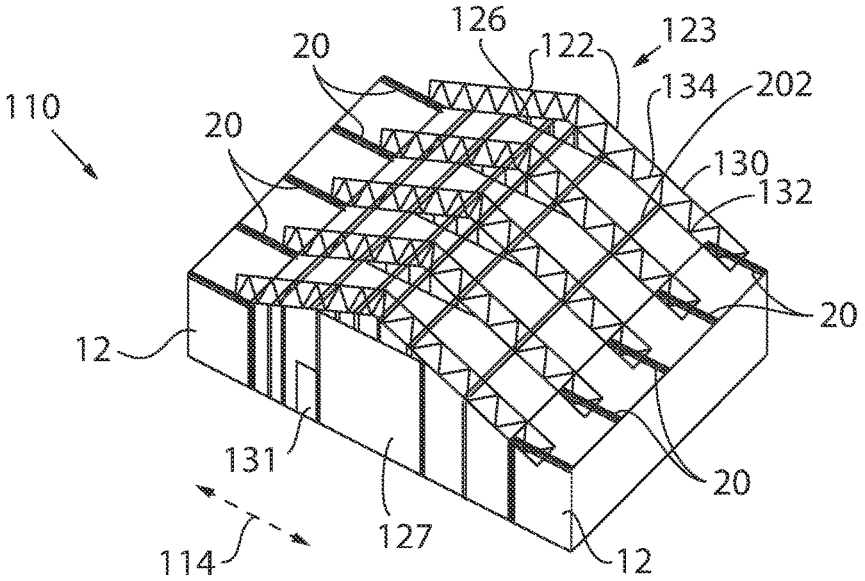
FIG. 12 is a perspective view of a structure constructed according to an alternative embodiment of the present invention showing shipping containers positioned to flank a structure volume spanned by gabled trusses in sliding connection with the shipping container.
Figure 13:
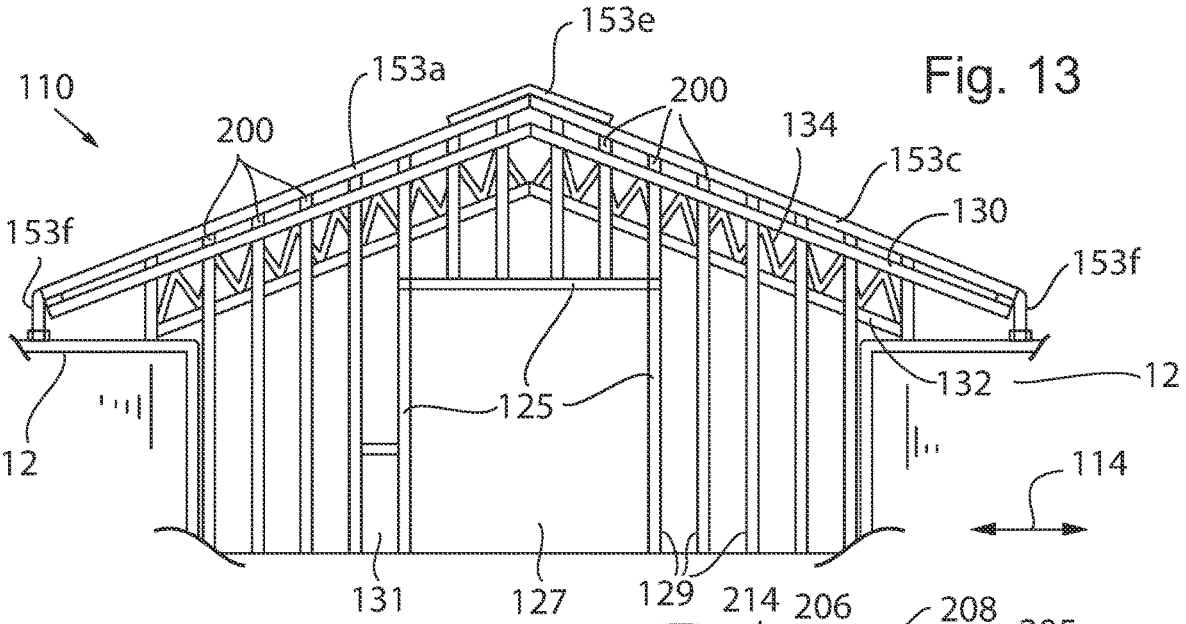
FIG. 13 is a front elevational view of the alternative embodiment of the present invention of FIG. 12 showing the use of vertical beams for completion of the end walls.

Referring to FIGS. 12 and 13, which is similar to FIGS. 1 and 11 described above and may share many of the same features, the structure 110 may include gabled planar trusses 122 extending transversely between the rails 20 and extending upwardly from each rail 20 to an apex 123 that may be constructed of light steel. The gabled planar trusses 122 is compatible with the rails 20 described above with respect to FIGS. 1 and 11 and is compatible with their connection to the ends of the shipping container 12 as described above.

The distance between the rails 20 extending along a transverse axis 114 and spanning between the shipping containers 12 may be 20 to 60 feet and may be nearly sixty feet and at least twenty feet and at least forty feet and at least sixty feet to provide larger building constructions therebetween. Therefore, the width of the trusses 122 may be at least sixty feet and greater than sixty feet to span the shipping containers 12. The gambrel planar trusses 122 may be constructed from two halves that are spliced by bolting at a vertical seam along the apex 123 for ease of construction, deconstruction and shipping.

The length of the trusses 122, extending perpendicular to the transverse axis 114, is dependent on the length of the shipping containers 12, for example 20 to 60 feet but is typically around forty feet long which is the standard length of a shipping container 12. The distance between adjacent trusses 122 extending along the length of the shipping containers 12 may be no more than and approximately five feet on center.

A total height at the apex 123 of the trusses 122 is near twenty feet and at least twenty feet which includes the height of the trusses 122. The height of the shipping container is typically around eight feet tall for a standard shipping container 12, therefore the apex 123 may be approximately twelve feet above the tops of the containers 12 at approximately midway between the containers 12.

The trusses 122 may support a load up to 60 pounds per square foot (psf) and up to 70 psf and withstand a wind speed of 150 mph.

Each of the trusses 122 provide for upper and lower transversely extending chords 130 and 132, respectively, with zigzagging diagonal struts 134 extending between the upper and lower chords 130 and 132 by welds. The upper chord 130 may provide an upper slope of the trusses 122 that is 4:12 (rise/run). The lower chord 132 may be similarly angled as it runs parallel to the upper chord 130.

Figure 14:
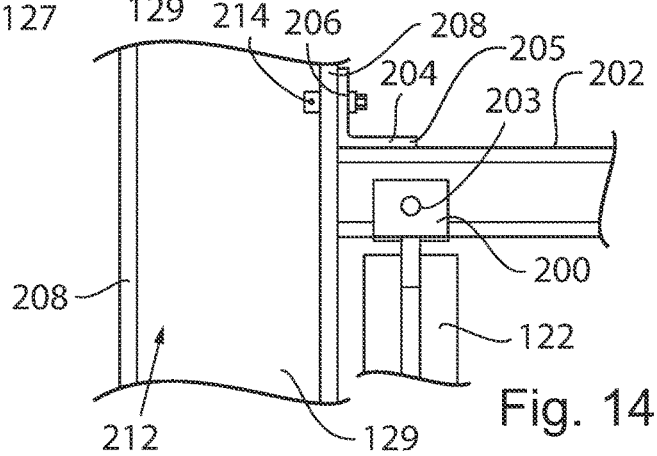
FIG. 14 is an elevational cross-sectional view through the vertical beam of the end walls and purlins showing the L-shaped angle bracket connecting the vertical beam to the purlin.

Referring briefly to FIG. 14, the upper chord 130 supports purlin cups 200 attached to the upper chord 130 of the truss 122 by weld or friction fit and may be spaced along the upper chord 30 of the truss 122 to receive rigid longitudinal braces or purlins 202 supporting thereon a flexible architectural fabric 153 as further described below. The purlin cups 200 may be spaced apart no more than and approximately two inches on center. The purlin cups 200 may be L-shaped or U-shaped supporting brackets with an upwardly extending arm or arms, with the purlin cups 200 being at least approximately 1.5 inches wide and having pre-drilled holes 203 which allow the purlins 202 to fit within the arms of the purlin cups 200 and attached to the purlin cups 200 by bolts.

The purlins 202 may be rigid, hollowed steel tubes with a rectangular cross section, e.g., hollowed structural structures (HSS), extending longitudinally between each truss 122 and joining each truss 122. Each purlin 202 is spaced apart no more than and approximately four feet on center along each truss 122. The purlins 202 may have an overall outside dimension of 3 inches by 2.5 inches with a wall thickness of 3/16 inch (HSS3×2.5×3/16).

A transverse stabilizer bar 126 may attach to the truss 122 at connection points on opposite ends of the apex 123, a first connection point being on one side of the apex 123 between the outer end of the truss 122 and the apex 123 and a second connection point being on the other side of the apex 123 between the outer end of the truss 122 and the apex 123. The purlins 202 and the stabilizer bar 126 generally resist longitudinal motion of the trusses 122 and bending or distortion of the trusses 122 thereby providing structural support.

Referring to FIGS. 13 and 14, which are similar to FIG. 11 described above and may share many of the same features, the vertical sidewalls of the structure 110 are formed by the vertically extending walls of the containers 12. The vertical end walls of the structure 110 may be formed by prefabricated beams 125 joined to the containers 12. The prefabricated beams 125 may include horizontal telescoping beams, described above with respect to FIG. 11, and vertical beams 129.

The vertical beams 129 may have a generally C-shaped cross section having two channel flanges 208 joined on one side and surrounding a rectangular channel 212. In one embodiment, the vertical beams 129 may be prefabricated American Steel C channel beams that are 8 inches deep, 2.527 inches wide, with 0.487 inches web thickness, a sectional area of 5.51 inches$^2$, and a weight of 18.75 lb/ft (C8×18.75). In an alternative embodiment where the prefabricated beams 25 frame a standard garage door 127 or the like and an adjacent personnel door 131 as seen in FIGS. 1 and 13, the vertical beams 129 may be American Steel C channel beams that are 15 inches deep, 3.4 inches wide, with 0.4 inches web thickness, a sectional area of 9.96 inches$^2$, and a weight of 33.9 lb/ft (C15×33.9).

The vertical beams 129 may be spaced apart along the end walls of the structure 110 at distances of 3 feet to 4 feet and approximately 3 feet 9.5 inches along the end walls. The vertical beams 129 may generally align with the position of the purlins 202, therefore spaced apart no more than and approximately four feet on center along axis 114 and may be connected to the purlins 202 by a right angle bracket as described below or double welded plate.

Referring specifically to FIG. 14, the vertical beams 129 may extend above the purlin 202 about a height of approximately 3 to 4 inches. A L-shaped angle bracket 204 providing legs 205, 206 attached at an approximately right angle (90 degrees) has the first leg 205 of the bracket 204 attached to a top side of the purlin 202 and bending upward to a second leg 206 of the bracket 204 attached to the vertical beam 129. The second leg 206 may be flush with an end of the purlin 202 and attached to a rear channel flange 208 of the vertical beam 129. The angle bracket 204 may be attached to the rear channel flange 208 by a bolt 214.

Figure 15:
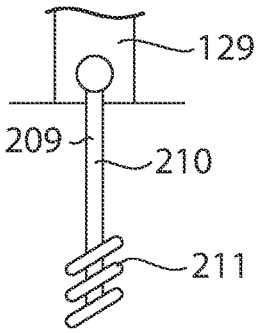
FIG. 15 is an elevational cross-sectional view through the ground anchors of the vertical beams showing engagement of the helix with the ground.

Referring to FIG. 15, bottom ends of the vertical beams 129 are directly anchored to the ground using ground anchors 209 the type of which may be selected depending on the soil conditions. In one embodiment, the ground anchors 209 used for anchoring the vertical beams 129 may be earth helix anchors having a central shaft 210 attached to the bottom end of the vertical beams 129 and having a helix 211 extending around the central shaft and buried within the ground (by rotating the central shaft 210 and helix 211 as it enters the ground) to resist upward vertical movement of central shaft 210 and to therefore resist longitudinal winds against the ends walls.

Figure 16:
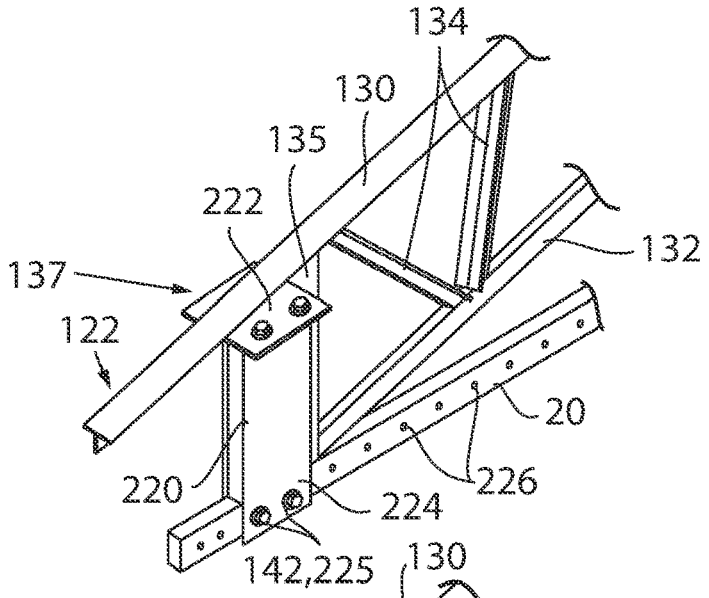
FIG. 16 is a fragmentary exploded perspective view of an alternative embodiment of the connection between an upper chord of the trusses and the shipping containers through connectors attached to rails by bolts extending through the rails.
Figure 17:
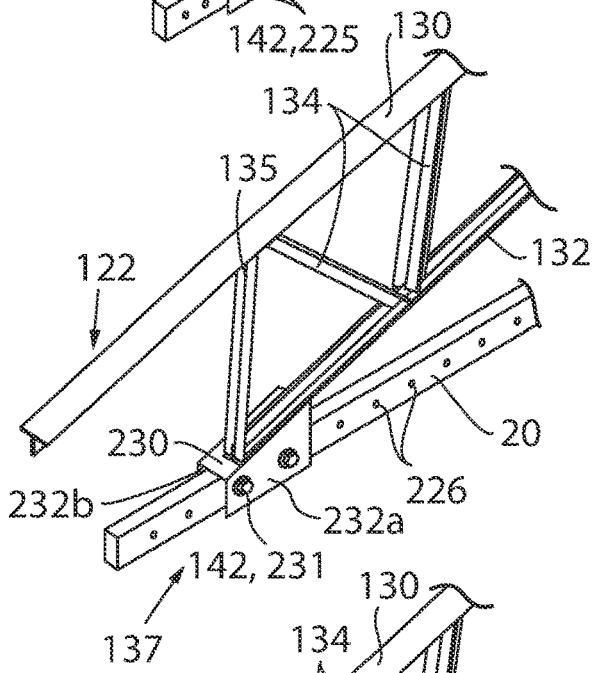
FIG. 17 is a fragmentary exploded perspective view of an alternative embodiment of the connection between a lower chord of the trusses and the shipping containers through connectors attached to rails by bolts extending through the rails.
Figure 18:
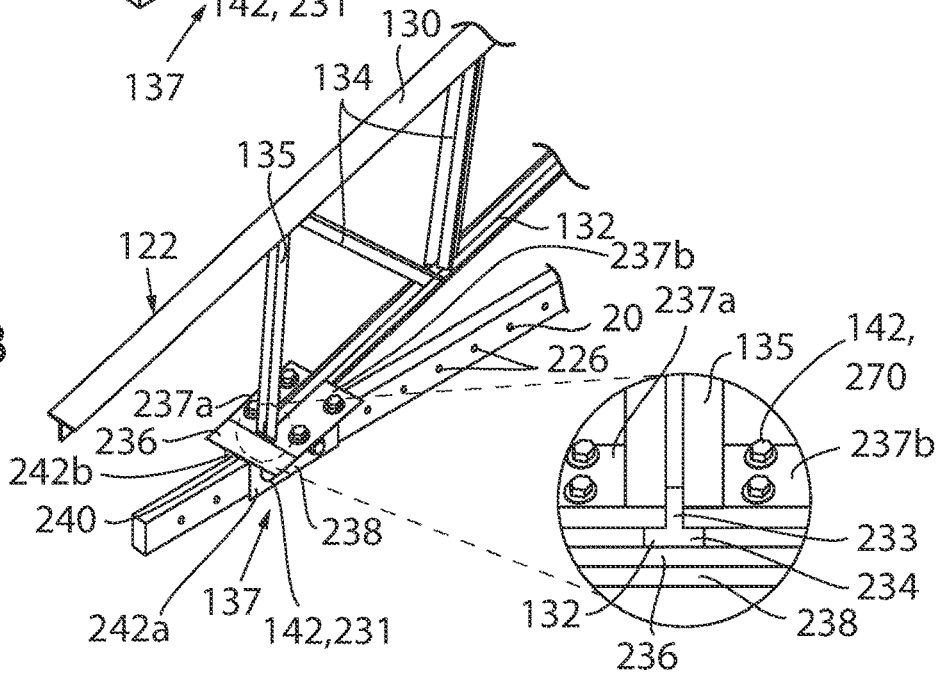
FIG. 18 is a fragmentary exploded perspective view of an alternative embodiment of the connection between a lower chord of the trusses and the shipping containers through connectors attached to rails by bolts extending through the rails.

Referring to FIGS. 16, 17, and 18, opposed ends of the upper and lower chords 130 and 132 are joined at each end by a vertical strut 135 (for example, welded between the upper chords 130 and lower chords 132). A coupling 137 is attached at each end of each truss 122 to attach each truss 122 to the rail 20 attached to the upper surface of the cargo container 12.

Referring specifically to FIG. 16, in one embodiment of the coupling 137, opposed ends of the upper and lower chords 130 and 132 are joined at each end by a coextending stub column 220 coextending with and along the vertical strut 135. The stub column 220 may be a rigid, hollowed tube with a rectangular cross section, e.g., a hollowed structural structure (HSS), extending upwardly from the rail 20 to the upper chord 130. The stub column 220 may have a rectangular cross section with overall outside dimensions of 4 inches by 2 inches with a wall thickness of 3/16 inch or 1/4 inch (HSS4×2×3/16 or HSSS7×3×1/4). The coextending stub column 220 distributes the weight of the truss 122 along an entire length of the stub column 220 thus distributing the load of the truss 122.

A horizontal bearing plate 222 may be welded (before or after assembly) to the bottom side of the upper chord 130. Optionally, the horizontal bearing plate 222 may be further connected by weld to the vertical strut 135. The horizontal bearing plate 222 may be welded to a top end of the stub column 220 and a bottom end of the stub column 220 may be attached to the rail 20 by clamping steel plates 224 extending downwardly from flanking sides of the front and back of the stub column 220 that may receive the rail 20. The clamping steel plates 224 may extend downwardly on the front and back sides of the rail 20 to be bolted and tightened through longitudinally aligned holes of the rail 20. The clamping steel plates 224 may be integral with the stub column 220, or alternatively, may be inverted T-shaped steel plates with a vertical portion attached to the bottom end of the stub column 220 and a horizontal portion having holes allowing for bolting to the front and back sides of the rail 20.

The bottom end of the clamping steel plates 224 have longitudinally aligned holes 225 receiving carriage bolts 142, for example, two 5/8 inch bolts, extending through the clamping steel plates 224 and spaced six inches on center and into corresponding longitudinally aligned holes 226 of the rail 20. The longitudinally aligned holes 226 of the rail 20 extend along both sides of the rail 20 along a length of the rail 20 permitting the position of the clamping steel plates 224 to be incrementally adjusted. The clamping steel plates 224 may be integral with the stub column 220 or may be welded or fastened to the bottom of the stub column 220.

Referring specifically to FIG. 17, in an alternative embodiment of the coupling 137, a lower surface of an end of the lower chord 132 may be welded onto a three-sided sleeve 228 of the coupling 137 that is generally a hollowed tube receiving the rail 20. The sleeve 228 provides an upper wall 230 and sidewalls 232*a* and 232*b* extending downwardly to flank the front and back sides of the rail 20. A corner formed by the lower chord 132 and the vertical strut 135 may be welded to the upper wall 230 of the sleeve 228 at approximately a center of the upper surface of the sleeve 228. The upper wall 230 of the sleeve 228 may be angled upward from the distal end of the truss 122 to the proximal end of the truss 122 to correspond with and receive the angled lower chord 130.

A lower end of the sleeve 228 may include longitudinally aligned holes 231 to receive carriage bolts 142 or the like at a traverse position on the rail 20, for example, two 5/8 inch bolts extending through the sleeve 228 spaced six inches on center. The rail 20 provides corresponding longitudinally aligned holes 226 on both sides of the rail 20 extending along a length of the rail 20 permitting the position of the sleeve 228 to be adjusted to prevent transverse movement. The sleeve 228 may have an overall outside dimension of 7 inches by 4 inches with a 3/16 inch wall thickness (HSS7×4×3/16).

In one embodiment, the sleeve 228 may be formed by attaching or welding three separate plates to form the upper wall 230 and sidewalls 232*a*, 232*b*. Alternatively, the sleeve 228 may be formed by a cut hollowed tube with a rectangular cross section, e.g., HSS stub column, to form the upper wall 230 and sidewalls 232*a*, 232*b*.

In an alternative embodiment, the sleeve 228 may comprise two separate halves (L 7×4×3/8 steel angles) with each half providing an upper wall 230 attached or welded to the lower chord 132 and a sidewall 232*a* or 232*b*, respectively. The upper wall 230 and the sidewall 232*a* or 232*b* of each half may be formed at a right angle where the upper wall 230 extends away from the lower chord 132.

Referring specifically to FIG. 18, in an alternative embodiment of the coupling 137, the lower chord 30 may be held by two clamp plates 237*a*, 237*b* of the coupling 137 flanking the lower chord 132. The lower chord 132 may have an inverted T shaped cross section having a vertical flange 233 extending upwardly from a midpoint of a horizontal flange 234. The two clamp plates 237*a*, 237*b* may flank the vertical flange 233 and overlap the horizontal flange 234 of the lower chord 132 to retain the lower chord 132 downward and against upward vertical movement. The two clamp plates 237*a*, 237*b* are further attached to a top end of a steel plate 236 attached to a top wall of a sleeve 238. The clamp plates 237*a*, 237*b* are attached to the steel plate 236 and the top wall of the sleeve 238 by vertically extending holes 270 receiving carriage bolts 142 or the like, for example, a pair of 5/8 inch bolts spaced 6 inches on center, which fasten the lower chord 132 to the steel plate 236 and sleeve 238. The steel plate 236 may by 3/16 inches thick and may be further welded to the top wall of the sleeve 238.

The sleeve 238 may be a hollowed tube receiving the rail 20, similar to the sleeve 230 of FIG. 17. The sleeve 238 has an upper wall 240 and sidewalls 242*a* and 242*b* extending downwardly to flank the front and back sides of the rail 20. An upper wall of the sleeve 238 may be angled upwardly from a distal end of the truss 122 to a proximal end of the truss 122 to correspond with the angle of the lower chord 132. A lower end of the sleeve 238 may include longitudinally aligned holes 231 to receive carriage bolts 142 or the like at a traverse position on the rail 20, for example, two ⅝ inch bolts extending through the sleeve 238 spaced six inches on center. The rail 20 provides corresponding longitudinally aligned holes 226 on both sides of the rail 20 extending along a length of the rail 20 permitting the position of the sleeve 238 to be adjusted to prevent transverse movement. The sleeve 238 may have an overall outside dimension of 7 inches by 4 inches with a 3/16 inch wall thickness (HSS7×4×3/16).

In one embodiment, the sleeve 230 may be two separate halves (L 7×4×⅜ steel angles) with each half providing an upper wall 230 and a sidewall 232*a* or 232*b*, respectively, as described above with respect to FIG. 17. An upper wall 230 and the sidewall 232*a* or 232*b* of each half may be formed at a right angle where the upper wall 230 extends away from the lower chord 132. The clamp plates 237*a*, 237*b* are attached to the upper wall 230 of the sleeve 230, for example, by bolt, for example, two ⅝ inch bolts, extending through the clamp plates 237*a*, 237*b* and spaced six inches on center.

In an alternative embodiment, the sleeve 230 may be two separate halves (L 3½×2½×¼ steel angles) with each half providing an upper wall 230 and a sidewall 232*a* or 232*b*, respectively. An upper wall 230 and the sidewall 232*a* or 232*b* of each half may be formed at a right angle where the upper wall 230 extends toward the lower chord 132 to join to form the upper wall 230. The clamp plates 237*a*, 237*b* are attached to the upper wall 230 of the sleeve 230, for example, by bolt, for example, two ⅝ inch bolts, extending through the clamp plates 237*a*, 237*b* and spaced six inches on center. Spacer plates may be positioned between the clamp plates 237*a*, 237*b* and the upper wall 230 of the sleeve 230.

When the lower ends of the sleeve 238 are spaced away form the rail 20, clevis pins may be used instead of carriage bolts with multiple cotter pins installed on and through each clevis pin (at the open end of the clevis pin and on each side of the rail 20) to prevent lateral movement of the sleeve 238 along the length of the clevis pin. The clevis pins may be 9 inch long pins extending through the sleeve 238 and spaced six inches on center.

Figure 19:
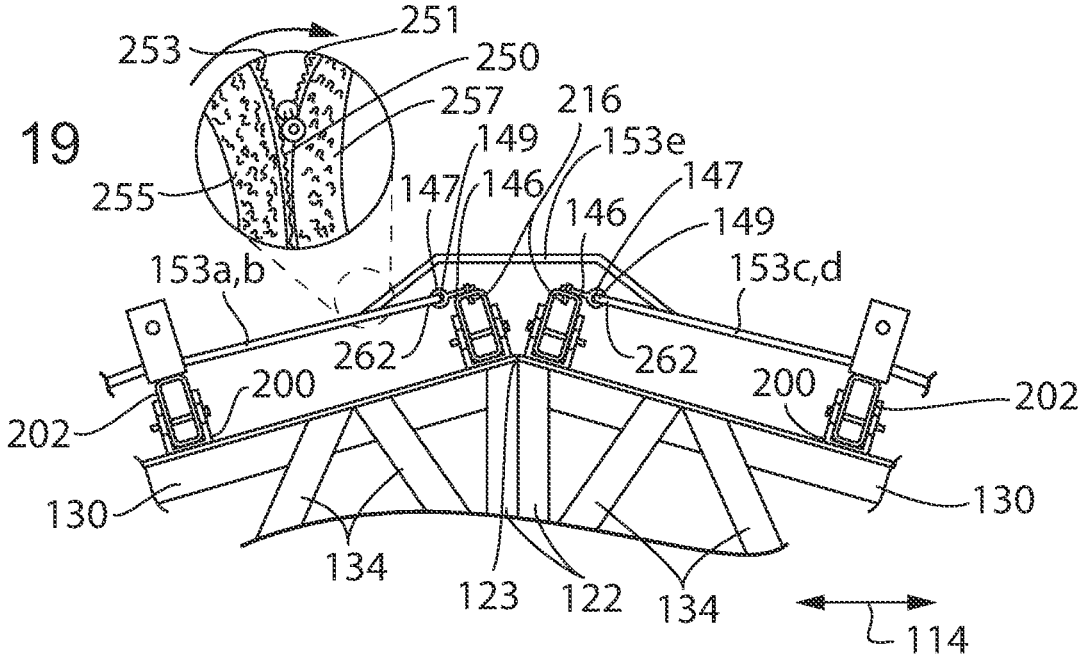
FIG. 19 is an elevational cross-sectional view through the trusses and purlins at and around an apex of the trusses showing flexible roofing material flanking the apex of the trusses.
Figure 20:
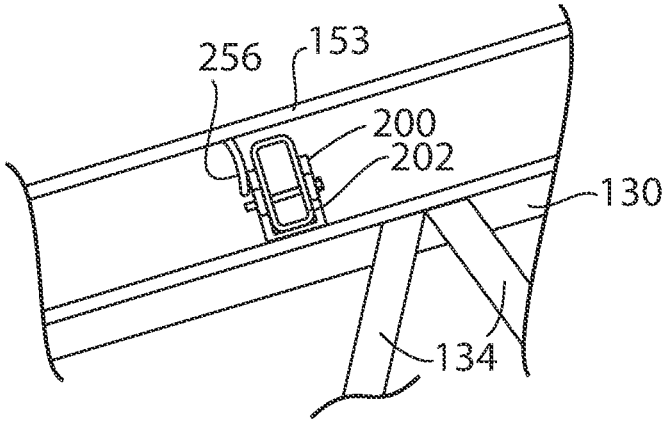
FIG. 20 is an elevational cross-sectional view through the trusses and purlins at an interior of the flexible roofing material showing engagement of the material with the purlins by fasteners.
Figure 21:
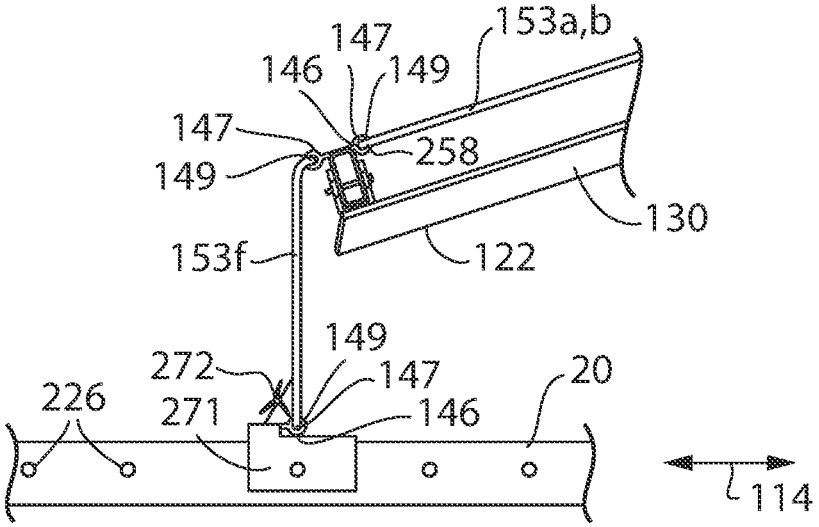
FIG. 21 is an elevational cross-sectional view through the trusses and purlins at outer ends of the trusses showing the flexible roofing material extending from ends of the trusses to the rail of the shipping containers.

Referring to FIGS. 19, 20, and 21, and similar to the description of FIG. 4 above, the outer surfaces of the structure 110 may be clad with a flexible architectural fabric 153 attached to the purlins 202 and which may be a vinyl material supporting a Keder strip 149, received by Keder rails 146 providing open circular channels 147 extending along the entire upper edge of the trusses 122. The Keder rails 146 may be attached to the upper edge of the trusses 122 by self-tapping screws 216 extending through the Keder rails 146 and the purlins 202 at one to six inch intervals.

Referring briefly to FIG. 4, these open circular channels 147 may receive the Keder strip 149, the latter providing a circular cross-section edge strip 151, for example, provided by a flexible PVC tube, and in turn joined by an attachment strip 152 which may be glued or welded to a flexible architectural fabric 153. In one embodiment, the attachment strip 152 may provide two layers of fabric which can flank the edge of the fabric 153 and be glued and welded onto the fabric 153. The fabric 153 may be vinyl or fabric that is known to be used for tents, for example, Keder's ULTRA 1900 coated vinyl, and spanning the entire at least 60-foot span of the trusses 122 and the entire length of the trusses 122.

In some instances, the Keder rail 146 may include one channel 147 receiving a Keder strip 149 of the fabric 153, for example, as described below with respect to fabric covering the apex 123 of the trusses of FIG. 19. In other instances, the Keder rail 146 may include two channels 147 ("double Keder rail"), as shown in FIG. 4, receiving Keder strips 149 of separate panels of fabrics 153 respectively allowing the joining of the separate panels of fabrics 153 as described below with respect to the outer edges of the trusses 122 of FIG. 21.

Referring to FIG. 19, the architectural fabric 153 may be assembled by combining multiple panels of fabric 153*a-d* approximately rectangular in shape, to assist with the rapid attachment to the structural components of the structure 110. In one embodiment, the structure 110 may include four panels of fabric 153*a-d* each covering a quadrant extending over the trusses 122 (e.g., panel of fabric 153*a* at the front left quadrant, panel of fabric 153*b* at the back left quadrant, panel of fabric 153*c* at the front right quadrant, panel of fabric 153*d* at the back right quadrant).

Longitudinal inner edges 262 of each panel of fabric 153*a-d* extending perpendicular to the transverse axis 114 and along the apexes 123 of the trusses 122 may include a Keder strip 149 received by a Keder rail 146 supported by the trusses 122 on each side of each apex 123 to join the longitudinal inner edge 262 of each panel of fabric 153*a-d* to the trusses 122.

A bridging panel 153*e* of material may extend perpendicular to the transverse axis 114 and overlap the apexes 23 of the trusses 122 to span a gap between the panels of fabric 153*a-d* on the left and right opposite sides, respectively, of the apexes 123. The bridging panel 153*e* is fastened to the panels of fabric 153*a-d* at the left and right opposite sides of the apexes 123 by a zipper attachment 250 having a first set of teeth 251 positioned at an outer edge of the supplemental panel and a second set of teeth 253 on a outwardly extending flap of the panels of fabric 153*a-d*. An overlapping flap of Velcro 255 may provide a water resistant seal extending over the zipper attachment 250 and attaching to mating Velcro 257 on the other side of the zipper attachment 250.

The bridging panel 153*e* may be approximately five to six feet wide to fully overlap the gap between the panels of fabric 153*a-d* and extend an entire length of the trusses 122. The bridging panel 153*e* may comprise of one or more separate panels that are joined along the length of the trusses 122.

Transverse inner edges of each panel of fabric 153*a-d* extending along the transverse axis 114 approximately midway between the front truss or front end wall and rear truss or rear end wall may include a zipper attachment 250, similar to the one described with respect to FIG. 19, with first and second sets of teeth 251, 253 positioned at outer edges of adjacent panels of fabric 153*a-d* to join the transverse inner edges of the panels of fabric 153*a-d*. Overlapping flaps with Velcro 257 mating with the Velcro 257 one the other side of the zipper attachment 250 may further provide a water resistant or water tight seal over the zipper attachment 250.

Referring now to FIG. 20, an interior of each panel of fabric 153*a-d* may be held down by a plurality of tie downs 254, for example, by snaps or fasteners, spaced throughout the panels 152*a-d* and installed on the purlins 202 to couple with corresponding fastener elements of straps or flaps 256 extending downwardly from the panels of fabric 153*a-d*. In one embodiment, the fasteners are lift-the-DOT fasteners which are typically locked on three sides and can only be opened by "lifting the dot" on one side, with the dot marked on the socket.

Referring now to FIG. 21, the longitudinal outer edges 258 of the each panel of fabric 153*a-d* extending perpendicular to the transverse axis 114 at the outer edges of the trusses 122 may include a Keder strip 149 received by a channel 147 of a double Keder rail 146 supported at the outer end of the trusses 122 which overhangs the top of the shipping container 12. Thus, the attachment of the Keder strip and channels 147 permits the attachment of the longitudinal outer edges 258 of each panel of fabric 153*a-d* to the outer edges of the trusses 122.

In order to bridge the gap between the outer end of the trusses 122 and the shipping container 12, a supplemental vertical panel 153*f* having an upper Keder strip 149 received into the second channel 147 of the double Keder rail 146 at a top end of the panel and having a lower Keder strip 149 received into a channel 147 of a Keder rail 146 at a bottom of the panel end encloses the gap below the overhanging truss 122. The Keder rail 146 at the bottom end of the vertical panel 153*f* may be attached to the rail 20 via a slidable bracket 271, the Keder rail 146 attached to the slidable bracket 271 and fastened to the longitudinally aligned holes 226 extending along the rail 20.

The vertical panel 153*f* may be one to two feet wide and approximately one foot four inches commensurate with the vertical distance between the truss 122 and the shipping container 12 and extend an entire length of the trusses 122.

The vertical panel 153*f* may carry a ratchet or alligator clamp 272 attached to the Keder rail 146 at the bottom end to pull the vertical panel 153*f* taunt after loosely being attached to the Keder rails 146.

The transverse outer edges 260 of each panel of fabric 153*a-d* extending along the transverse axis 114 at a front truss 122 or front end wall and rear truss 122 or rear end wall may include vinyl snaps or fasteners to attach the panels of fabric 153*a-d* to the transversely extending trusses 122.

It is understood that any combination of Keder strips 149 and Keder rails 146 and Velcro, snaps, and fasteners may be used to clad the outer surfaces of the structure 110 with a flexible architectural fabric 153.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

What we claim is:

1. A building comprising:

a first and second shipping container separated along a first axis in spaced opposition flanking a building volume;

a set of rails extending parallel to the axis and releasably attached to upper surfaces of the first and second shipping containers;

a set of trusses extending between endpoints of each truss; and connectors attaching the endpoints of each truss to opposed, corresponding said rails on the first and second shipping containers, the connectors attachable to the rails;

wherein the connectors are configured to releasably fasten to the rails at a range of predetermined positions along the rails;

wherein the connectors provide clamp surfaces receiving walls of the rails therebetween to slidably guide the connector along the rails and then to fasten to the rails by bolt through holes in the rails;

wherein lower ends of the clamp surfaces include a pair of holes aligned with a pair of holes in the rails for receiving bolts therethough;

wherein the connectors provide connection plates attached to the endpoints of each truss; and wherein the connection plates are angled to receive a lower angled surface of the truss.

2. A building comprising:

a first and second shipping container separated along a first axis in spaced opposition flanking a building volume;

a set of rails extending parallel to the axis and releasably attached to upper surfaces of the first and second shipping containers;

a set of trusses extending between endpoints of each truss, each truss comprising transversely extending support beams joining at an apex; and connectors configured to connect transversely extending ends of the support beams of each truss to opposed, corresponding said rails on the first and second shipping containers, wherein the connectors are releasably fastened to the rails at a range of predetermined positions along the rails;

wherein the rails contain a plurality of holes extending perpendicular to the axis through the rail and spaced in separation along the axis, the plurality of holes configured to selectively receive bolts therethrough to couple the connectors and the rails.

3. The building of claim 2 wherein the first and second container are separated by about 60 feet.

4. The building of claim 2 wherein the connectors provide clamp surfaces receiving walls of the rails therebetween to slidably guide the connector along the rails and then to fasten to the rails by bolt through holes in the rails.

5. The building of claim 4 wherein lower ends of the clamp surfaces include a pair of holes aligned with a pair of holes in the rails for receiving bolts therethough.

6. The building of claim 5 wherein the connectors provide connection plates attached to the endpoints of each truss.

7. The building of claim 6 wherein the clamp surfaces are plates extending vertically downward from the connection plates and flanking both sides of the rails.

8. The building of claim 7 wherein the trusses are gable trusses angling upward from each shipping container to an apex point positioned between the shipping containers and each truss includes upper and lower chords joined by a vertical strut and a support rail attached on opposite sides of the apex point.

9. The building of claim 8 wherein the connection plates are attached to a lower surface of the upper chord of each truss.

10. The building of claim 8 wherein the connection plates are attached to a lower surface of the lower chord of each truss.

11. The building of claim 10 wherein the connection plates provide clamp surfaces receiving a vertical wall of the lower chord and overlapping lower walls of the lower chord to prevent upward motion of the truss.

12. The building of claim 2 further including a set of purlins extending perpendicular to the set of trusses wherein the purlins are steel tubes.

13. The building of claim 12 further including vertical beams attaching to facing walls of the first and second shipping containers at ends of the first and second shipping containers.

14. The building of claim 13 further including beam connectors attaching the vertical beams to the set of purlins, the connectors being L-shaped brackets attachable to the vertical beams and purlins at approximate 90 degree angles.

15. The building of claim 13 wherein the vertical beams are anchored below ground by helix anchors.

16. The building of claim 12 wherein the purlins support rails for receiving and retaining polymer sheet material to cover an upper surface of the trusses as a roof.

17. The building of claim 16 wherein the sheet material includes Keders and wherein the rails provide Keder channels for retaining the Keders.

18. The building of claim 17 wherein the sheet material comprises multiple panels of material and the panels of material include zippers and flaps of Velcro extending over the zippers for sealably joining multiple panels of material.

19. The building of claim 18 further including a supplemental panel of material attached at one end to an endpoint of each truss and attached at a second end to the rail to span an opening between the truss and the rail.

20. The building of claim 18 further including a supplemental panel of material spanning an apex point of the trusses positioned between the shipping containers attached to attachment point on opposite sides of the apex point.

21. A method of constructing a building employing components of:

a first and second shipping container separated along a first axis in spaced opposition flanking a building volume;

a set of rails extending parallel to the axis and releasably attached to upper surfaces of the first and second shipping containers;

a set of trusses extending between endpoints of each truss, each truss comprising transversely extending support beams joining at an apex; and connectors configured to connect transversely extending ends of the support beams of each truss to opposed, corresponding said rails on the first and second shipping containers, wherein the connectors are releasably fastened by bolts to the rails at a range of predetermined positions along the rails, wherein the rails contain a plurality of holes extending perpendicular to the axis through the rail and spaced in separation along the axis, the plurality of holes configured to selectively receive the bolts therethrough to couple the connectors and the rails, the method comprising the steps of:

(a) placing the first and second shipping containers in separation along a first axis in spaced opposition flanking a building volume;

(b) attaching the set of rails to the upper surfaces of the first and second shipping containers to extend parallel to the axis and be separated from each other perpendicular to the axis; and (c) attaching the trusses to the rails using the connectors.

* * * * *